United States Patent [19]

Pivarunas

[11] Patent Number: 4,611,542

[45] Date of Patent: Sep. 16, 1986

[54] PERSONALIZED TOWING DEVICE

[76] Inventor: Anatoly Pivarunas, 2700 Bathurst St., Apt. 815, Toronto, Ontario, Canada, M6B 2Z7

[21] Appl. No.: 666,768

[22] Filed: Oct. 31, 1984

[51] Int. Cl.[4] ..... B61B 11/00; B66D 1/48

[52] U.S. Cl. ..... 104/173 ST; 104/178; 104/196; 254/268

[58] Field of Search ..... 104/173 ST, 178, 196, 104/183; 254/268, 329, 270, 269

[56] References Cited

U.S. PATENT DOCUMENTS

| | | | |
|---|---|---|---|
| 3,166,021 | 1/1965 | Schippers | 104/173 ST |
| 3,739,728 | 6/1973 | Thompson | 104/173 ST |
| 3,779,171 | 12/1973 | Littlehorn, Jr. | 104/173 ST |
| 4,023,502 | 5/1977 | Elsing | 104/173 ST |
| 4,047,487 | 9/1977 | Wyss | 104/173 ST |

*Primary Examiner*—Randolph A. Reese
*Assistant Examiner*—David F. Hubbuch
*Attorney, Agent, or Firm*—Hirons, Rogers & Scott

[57] ABSTRACT

The invention provides a portable towing device for downhill or water skiers which includes a drive unit. This drive unit comprises a motor and a drive pulley connected to the motor by a rotor which is rotated by the motor. The motor has an actuator which is movable from an idle position wherein the motor idles to an increased power position wherein the power output of the motor is increased. A first anchor is used to anchor the drive unit in the ground in a stationary position. There is also second anchor which is engageable in the ground at a distance from the drive unit and which has a support pulley connected thereto. An endless cable extends between and is entrained about the drive pulley and the support pulley and has an upper portion and a lower portion. A switch comprising a linkage is rotatably connected to the actuator at one end and to the cable at the other end by a regulator roller. This switch is operable to move the actuator to the idle position when the tension of each of the portions of the cable on the regulator roller are equal and to move the actuator to the increased power position when the tension of the portions of the cable are unequal.

3 Claims, 2 Drawing Figures

PERSONALIZED TOWING DEVICE

The invention relates to a towing device and more particularly to a personalized towing device for downhill or water skiers.

There are in existence many towing devices which are sophisticated and expensive from both an installation and operational point of view.

It is an object of the present invention to obviate or mitigate the above-mentioned disadvantages.

Accordingly, the invention provides a portable towing device for downhill or water skiers which include a drive unit. This drive unit comprises a motor and a drive pulley connected to the motor by a rotor which is rotated by the motor. The motor has an actuator which is moveable from an idle position wherein the motor idles to an increased power position wherein the power output of the motor is increased. First anchor means are used to anchor the drive unit in the ground in a stationary position. There are also second anchor means which are engageable in the ground at a distance from the drive unit and have a support pulley connected thereto. An endless cable extends between and is entrained about the drive pulley and the support pulley and has an upper portion and a lower portion. Switching means connected to the actuator at one end and to the cable at the other end is also provided. This switching means is operable to move the actuator to the idle position when the tension of each of the portions of the cable on the pulley are equal and to move the actuator to the increased power position when the tension of the portions of the cable are unequal.

The invention is intended for personal use. It is lightweight, portable and easy to install. Operation is simple and requires very little maintenance. Basically, this towing device for downhill and water skiers centres around a simple load sensing mechanism which automatically activates highoperational or slow idle speeds when a skier engages or disengages the cable. This is a safety feature and eliminates the danger of skier accident by grabbing a cable in rapid motion and being thrown off balance.

The device optimizes a skier's time for skiing as the skier does not need to spend a good portion of his/her time in line-ups or on the lift. The portable feature and the easy installation of this device provide flexibility in the types of terrain where the device can be used. The high operational speed of the towing device allows a group of skiers to use the lift sequentially with minimum waiting time. As the device is used by one skier at a time the need for a high power motor as required by fixed installation, heavy multi-person lifts is eliminated.

Figure 1:
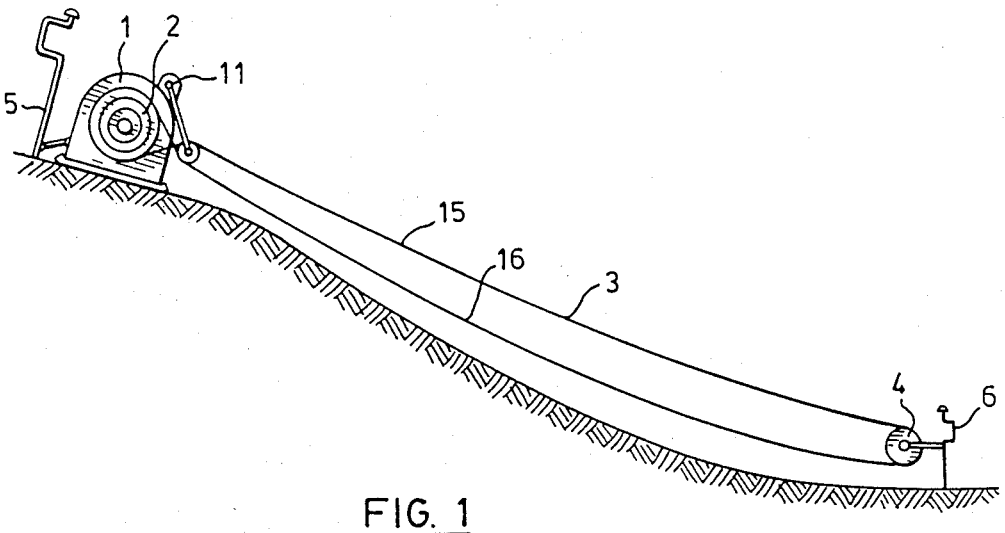
Figure 2:
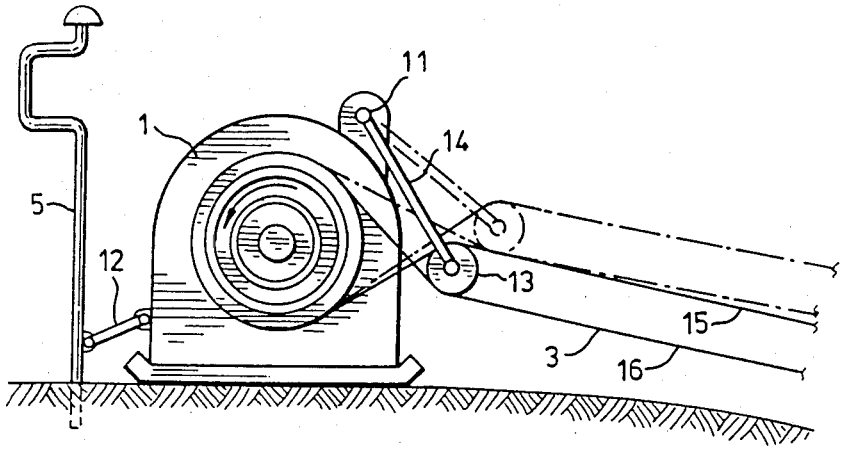

The invention will now be described by way of example only, with reference to the following drawings in which:

FIG. 1 is an overall layout of the invention wherein a personalized towing device is mounted on a slope; and FIG. 2 is a side view of a drive unit used in the device of FIG. 1.

Referring to FIG. 1, it can be seen that a personalized towing device consists of a drive unit 1, whose rotor carries a drive pulley 2. An endless, load-carrying cable 3 is entrained by the drive pulley 2 and a support pulley 4 located downhill from the drive pulley. This cable has an upper portion 15 and a lower portion 16. The drive unit 1 and the support pulley 4 are secured to the slope by anchoring pins 5 and 6 respectively.

As can best be seen in FIG. 2, the drive unit 1 is anchored to the pin 5 by a rigid link 12. The drive unit 1 is equipped with a regulator roller 13 which is connected through a linkage 14 to an actuator 11. The regulator roller 13 is embraced by the upper and lower portions 15, 16 of the cable 3.

The operation of the device will now be described with reference to FIGS. 1 and 2. In the position shown in FIG. 2, there is equal tension on both portions 16, 17 of the cable. The regulator roller 13 is therefore in a balanced position and the drive unit 1 is idling. When a skier engages the upper portion 15 of the cable 3, the tension on this portion 15 of the cable 3 is increased and the tension on the lower portion 16 is reduced. This difference in tension causes the regulator roller 13 to be displaced from its original position (as shown by the dotted lines). This displacement causes the linkage 14 to switch the actuator 11 thereby activating the drive unit 1 to drive the cable 3 at high towing speed.

When the skier disengages from the cable 3, the reverse action takes place. Equal tension between the portions 15, 16 of the cable is restored, regulator roller 13 returns to its initial balanced position, and the actuator 11 switches back so the drive unit returns to its idling speed.

The drive unit 1 can be a carburetor engine or an electric motor and the actuator 11 can be either the throttle of a carburetor or a power switch of an electric motor.

I claim:

1. A portable towing device comprising:

a drive unit comprising a motor and a drive pulley connected to said motor by a rotor which is rotated by said motor, said motor having an actuator, said actuator being moveable from an idle position wherein said motor idles to an increased power position wherein the power output of said motor is increased;

first anchor means to anchor said drive unit in the ground in a stationary position;

second anchor means engageable in the ground at a distance from the drive unit and having a support pulley connected thereto;

an endless cable extending between said entrained about said drive pulley and said support pulley, having an upper portion and a lower portion; and switching means connected to said actuator at one end and to said upper and lower portions of said cable at the other end, said switching means operable to move said actuator to said idle position when the tension of each of said portions of said cable on said pulley are equal and to move said actuator to an increased power position when the tension of said portions of said cable are unequal.

2. A portable towing device as claimed in claim 1 wherein only one skier can use the towing device at a time.

3. A portable towing device as claimed in claim 1 wherein said switching means comprises a linkage rotatably connected to said actuator at one end and connected to a regulator roller at the other end, said regulator roller being embraced by said upper and lower portions of said cable, wherein said roller is at a balanced location when the tension is equal and is at an unbalanced location when said tension is unequal and wherein the linkage is rotated and acts against the actuator to move the actuator to an increased power position.

* * * * *